US005788382A

United States Patent [19]

Egbert et al.

[11] Patent Number: 5,788,382

[45] Date of Patent: Aug. 4, 1998

[54] IMAGING DRUM

[75] Inventors: Benjamin L. Egbert; Paul J. Paroff; Mark C. Gaskievicz, all of Spokane, Wash.

[73] Assignee: Output Technology, Inc., Spokane, Wash.

[21] Appl. No.: 919,521

[22] Filed: Aug. 28, 1997

[51] Int. Cl.[6] ..... B41J 2/00

[52] U.S. Cl. ..... 400/118.3; 399/92; 399/96; 399/330; 101/375

[58] Field of Search ..... 400/118.3; 101/375, 101/487, 489; 399/31, 32, 44, 52, 53, 96, 97, 111, 117, 330, 333; 355/277, 279

[56] References Cited

U.S. PATENT DOCUMENTS

| | | | |
|---|---|---|---|
| 4,319,828 | 3/1982 | Komori et al. | 399/96 |
| 4,585,319 | 4/1986 | Okamoto et al. | 399/96 |
| 4,607,936 | 8/1986 | Miyakawa et al. | 399/96 |
| 4,823,160 | 4/1989 | Ikuta et al. | 399/117 |
| 5,019,682 | 5/1991 | Nakamura et al. | 399/96 |
| 5,130,751 | 7/1992 | Sato et al. | 399/117 |
| 5,151,737 | 9/1992 | Johnson et al. | 399/117 |
| 5,550,621 | 8/1996 | Ogawahara | 399/92 |
| 5,659,866 | 8/1997 | Kim | 399/330 |
| 5,689,766 | 11/1997 | Hollar et al. | 399/92 |

*Primary Examiner*—Eugene H. Eickholt

[57] ABSTRACT

An imaging drum assembly is disclosed and which includes an inner substantially cylindrically shaped sleeve, the inner sleeve having an outwardly facing surface, and an inwardly facing surface, and wherein the inwardly facing surface has a plurality of spaced, inwardly regularly extending projections which define a cavity; and an outer, substantially shaped sleeve, the outer sleeve telescopingly receiving the inner sleeve, and wherein the outer sleeve has an outwardly facing surface, and an inwardly facing surface which is disposed in energy transmitting relation relative to the outwardly facing surface of the inner sleeve, and wherein the outwardly facing surface of the outer sleeve has a given minimum capacitance.

20 Claims, 4 Drawing Sheets

IMAGING DRUM

TECHNICAL FIELD

The present invention relates to an imaging drum, and more specifically to an imaging drum which is maintained at a given temperature to facilitate the formation and transfer of a printed image to a substrate and which further facilitates the efficient operation of an associated printer.

BACKGROUND OF THE INVENTION

The operation of electrographic printers is well known. Such printers reproduce, on a given media, or substrate, computer generated signals as might be provided by a word processing or other type of computer software program. These printers commonly include an imaging cylinder mounted in force transmitting relation relative to an impression or pressure cylinder, and further, a substrate, such as, for example, a web of paper passes between the imaging and impression cylinders. When this event occurs, the web receives the desired printed image which is transferred by the imaging cylinder.

Imaging cylinders are well known. In particular, these assemblies comprise a rotatable drum having an exterior facing dielectric layer having given dielectric properties which are effective to receive and retain electrostatic latent images formed by a closely adjacent ion or print cartridge. The ion or print cartridge is further electronically coupled with a computer which is implementing a given software. The electrostatic image provided on the imaging cylinder is contacted or provided with toner which is dispensed from a supply of same. This electrostatic image which is now defined by toner, is then transferred to the print medium as the imaging cylinder moves into force engaging contact with the associated impression or pressure cylinder. After the transfer of the image, further rotation of the imaging cylinder causes it to pass through an associated cleaning station which substantially removes any remaining solid particulate matter adhering to same; and finally, a discharge assembly removes any residual electrostatic charge on the imaging cylinder. Thereafter, the cycle repeats itself, and a fresh electrostatic latent image may be formed on the dielectric layer by the associated ion or print cartridge.

While the imaging cylinders of the prior art have operated with varying degrees of success, they have had shortcomings which have detracted from their usefulness. More specifically, it has been recognized that the ion deposition process must be maintained within given temperature parameters to be effective. For example, the exterior surface of the imaging drum must be maintained below a temperature of 80 degrees C., otherwise the surface of the imaging drum begins to degrade. Further, it has also been recognized that the ion deposition process, that is, the formation of the electrostatic image on the imaging drum begins to disappear once the temperature of the exterior surface of the imaging drum falls below 50 degrees C. At this temperature, the image will no longer form or forms inefficiently. Additionally, as the temperature approaches the maximum level the toner melts on the imaging drum thus failing to form a desired image, and/or fails to transfer to the fusing drum. As will be recognized, the resulting printed product is less than ideal and the efficiency with which the printer utilizes a given volume of toner drops to unacceptable levels.

An improved imaging drum which is operable to obtain the individual benefits and advantages to be derived from related prior art devices and apparatus and which avoids the assorted detriments individually associated therewith, is the subject matter of the present invention.

SUMMARY OF THE INVENTION

Therefore, one aspect of the present invention is to provide an improved imaging drum assembly.

Another aspect of the present invention is to provide an imaging drum assembly which includes an inner, substantially cylindrically shaped sleeve, the inner sleeve having an outwardly facing surface and an inwardly facing surface, and wherein the inwardly facing surface has a plurality of spaced, inwardly radially extending projections which define a cavity; and an outer, substantially cylindrically shaped sleeve, the outer sleeve telescopingly receiving the inner sleeve, and wherein the outer sleeve has an outwardly facing surface, and an inwardly facing surface which is disposed in energy transmitting relation relative to the outwardly facing surface of the inner sleeve, and wherein the outwardly facing surface of the outer sleeve has a given minimum capacitance.

Still another aspect of the present invention relates to an imaging drum assembly which includes an axle having a main body and defining an axis of rotation, and wherein the main body of the axle has opposite first and second ends, and wherein an air intake passageway is formed in the main body of the axle and which extends substantially coaxially from the first end of the main body to the second end thereof, and wherein a plurality of radially disposed apertures are formed in the main body of the axle and communicate with the air intake passageway;

a pair of collars telescopingly borne on the axle and disposed in spaced relation one to the other, the individual collars each having a main body which is oriented substantially radially outwardly relative to the axle;

a bearing mounted adjacent to each collar and which facilitates rotation of the collar and axle about a given longitudinal axis;

an inner, substantially cylindrically shaped sleeve borne by the pair of collars and rotatable with the axle, the inner sleeve having opposite ends, an outwardly facing surface, and an inwardly facing surface, and wherein the inwardly facing surface has a plurality of spaced inwardly radially extending projections which define a cavity, and wherein the individual collars matingly engage the opposite ends of the inner substantially cylinderally shaped sleeve; and an outer, substantially cylindrically shaped sleeve, the outer sleeve telescopingly receiving the inner sleeve, and wherein the outer sleeve has an outwardly facing surface, and an inwardly facing surface which is disposed in energy transmitting relation relative to the outwardly facing surface of the inner sleeve, and wherein the outer facing surface of the outer sleeve has a given minimum capacitance.

Yet a further aspect of the present invention relates to an imaging drum assembly which includes a fan assembly mounted in fluid transmitting relation relative to the air intake passageway of the axle, the fan assembly urging a supply of air through the air intake passageway and into the cavity.

Yet still another aspect of the present invention is to provide an imaging drum assembly which includes a selectively adjustable heater which is disposed in heat transferring relation relative to the supply of air.

Moreover, another aspect of the present invention relates to an imaging drum assembly which includes a sensor mounted in spaced heat sensing relation relative to the outwardly facing surface of the outer sleeve, and wherein the sensor is coupled in signal transmitting relation relative to the selectively adjustable heater.

Further, another aspect of the present invention relates to a control assembly which is electrically coupled with the sensor, heating assembly and fan assembly, and wherein the control assembly upon receiving a given signal from the sensor selectively energizes the selectively adjustable heater and fan for given time periods to effectively maintain the temperature of the outwardly facing surface of the outer sleeve at a temperature of about 50 degrees C. to about 80 degrees C.

BRIEF DESCRIPTION OF THE DRAWINGS

Preferred embodiments of the invention are described below with reference to the following accompanying drawings.

FIG. 4 is an enlarged, partial, perspective view of the imaging drum of the present invention.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 3:
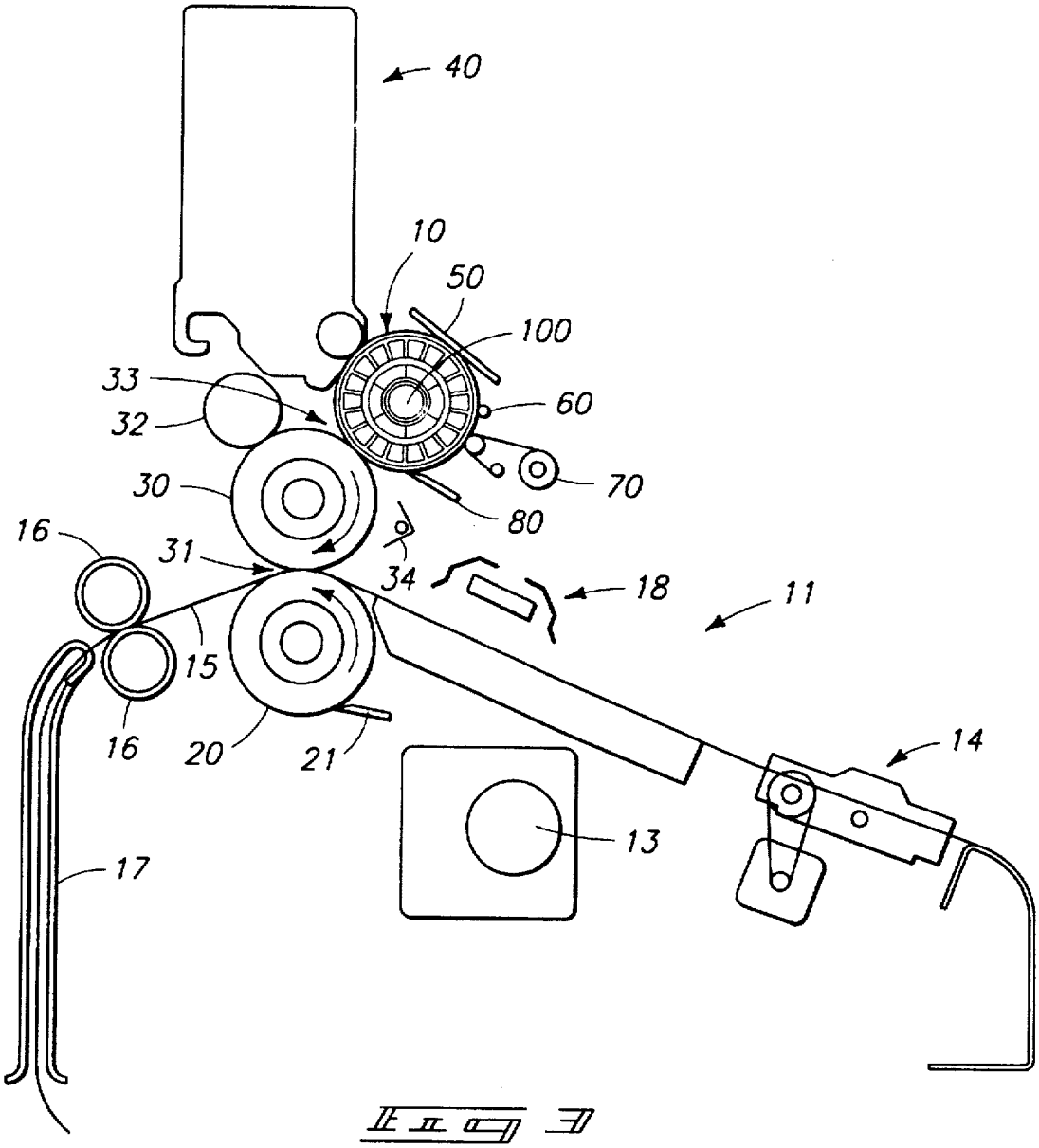
FIG. 3 is a greatly simplified, transverse, vertical sectional view of a printer which incorporates the imaging drum of the present invention.
Figure 11:
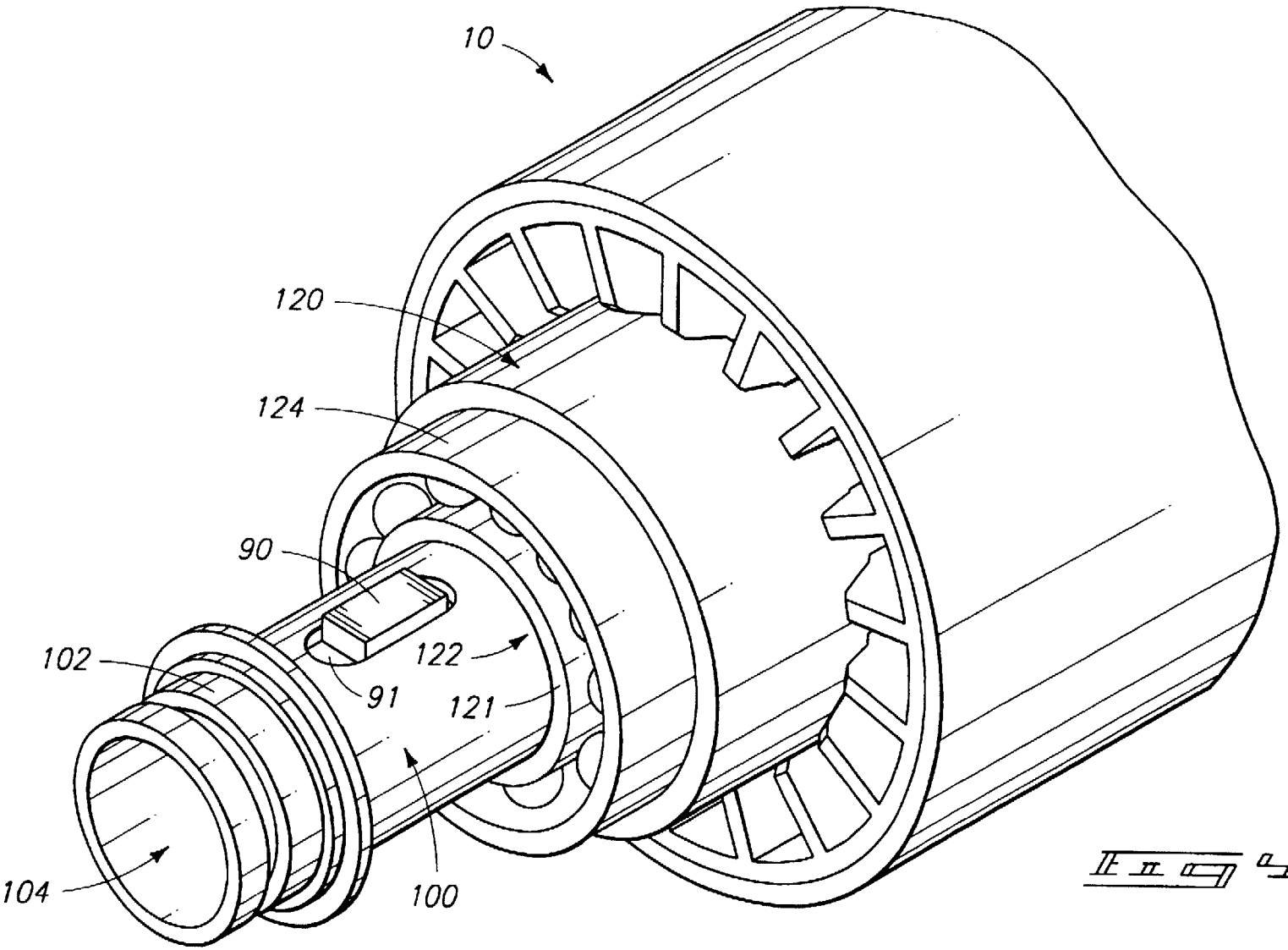

The imaging drum assembly 10 is best seen in the greatly simplified view shown in FIG. 3. As illustrated therein, the imaging drum 10 is incorporated into a printer 11. The printer 11 has a frame (not shown) which mounts a motor 13. The motor 13 is connected in force transmitting relation relative to the imaging drum 10 to impart predetermined rotatable motion to same. The printer 11 further has a media or substrate feeding mechanism 14 which is operable to move a given media or substrate 15 to be printed into the printer 11. Further, a pair of outfeed rollers 16 frictionally engage the printed substrate 15 and pull it from the printer 11. The substrate 15 is then directed to an associated guide member 17 which directs it to a location exterior of the printer for collection and removal. As best seen in FIG. 3, the printer 11 includes a preheater assembly 18 which is operable to impart heat energy to the substrate 15 which is traveling closely adjacent thereto.

As further seen in FIG. 3, the printer 11 includes a rotatable pressure drum 20. A scraper 21 is positioned in contact with the pressure drum 20 to remove any debris or other particulate matter which is transported into the printer by the substrate. A rotatable fusing drum 30 is mounted in rotatable contact with the underlying and adjacent pressure drum 20. The fusing drum 30 and the pressure drum 20 come together, at a first nip which is indicated by the numeral 31. Further, a rotatable cleaning drum 32 is mounted in rotatable contact with the fusing drum and is operable to remove particulate matter and other debris which may adhere to the rotatable fusing drum. Yet further, a second nip 33 is defined between the fusing drum 30 and the adjacent imaging drum 10. Additionally, a radiant heater 34 is mounted in heat transferring relation relative to the fusing drum. As should be understood, the imaging drum, through frictional engagement with the fusing drum, imparts motion to same. Similarly, the frictional engagement of the fusing drum with the pressure drum imparts rotatable motion to same.

A toner dispensing assembly 40 (FIG. 3) is disposed in dispensing relation relative to the imaging drum 10 to deposit a source of toner which will adhere to an electrostatic image which is formed on the surface of same. This electrostatic image (not shown) is formed on the surface of the imaging drum by an imaging assembly/print cartridge which is generally indicated by the numeral 50. The construction of the print cartridge is well understood, and therefore for purposes of brevity is not discussed in further detail herein. An eraser assembly 60 is mounted adjacent to the imaging drum 10 and is utilized to remove an electrostatic image previously formed on the imaging drum following the printing of the image. Additionally, a cleaning assembly 70 is mounted in upstream spaced relation relative to the eraser assembly 60. The cleaning assembly is utilized to remove any particulate matter, and toner which remains adhered to the imaging drum assembly 10. A second scraper 80 is mounted in contact with the imaging drum assembly 10 and is also utilized to remove any remaining particulate matter, such as toner, which continues to adhere to the surface of the imaging drum.

Specific features of the printer 11 and more particularly, the operational parameters of the pressure drum, and fusing drum will be discussed in greater detail hereinafter.

Figure 2:
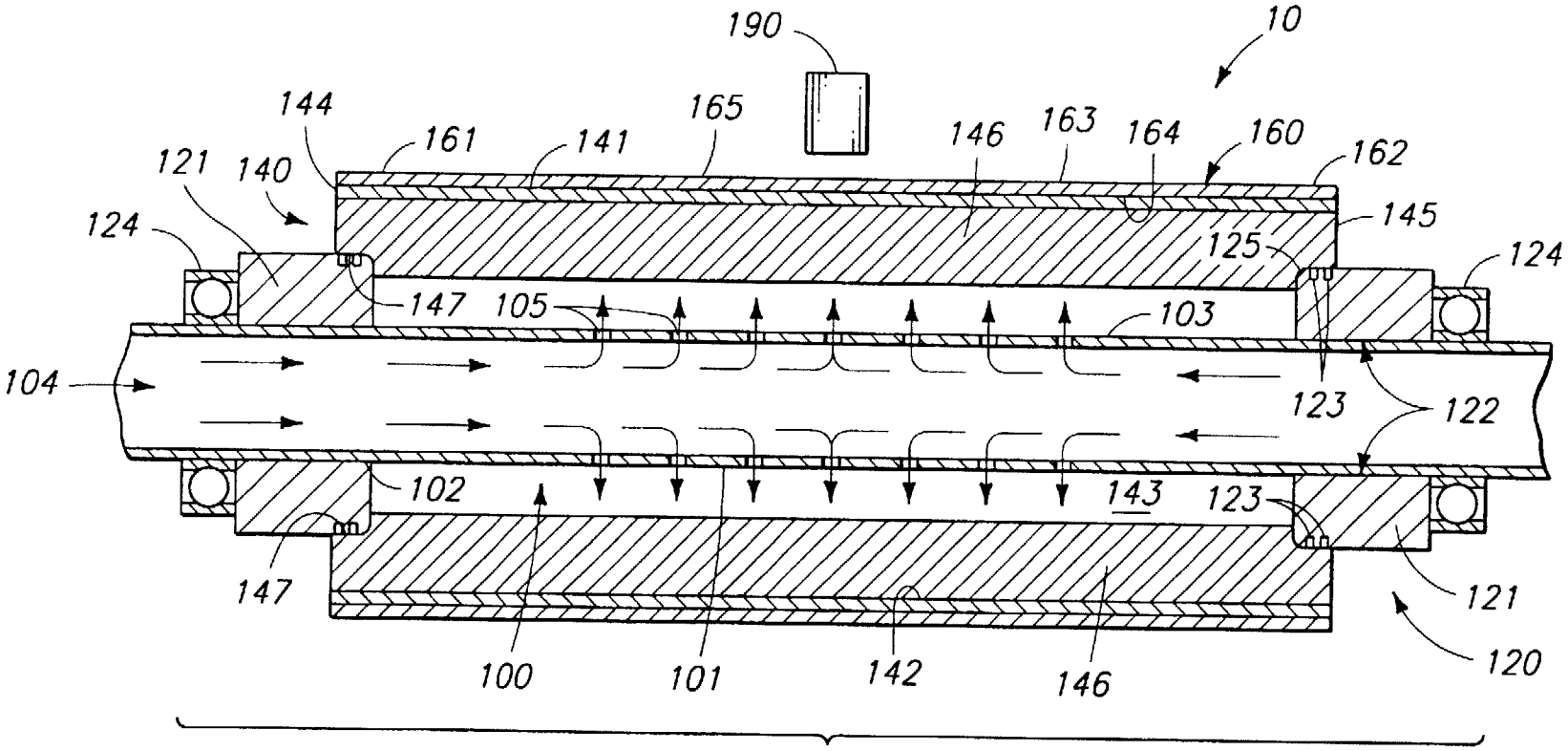
FIG. 2 is a greatly simplified fragmentary, longitudinal, vertical sectional view taken from a position along line 2—2 of FIG. 1.

Referring now to FIG. 2, the imaging drum assembly 10 of the present invention is mounted for rotational movement in the printer 11 by means of an axle which is generally indicated by the numeral 100. The axle 100 has a main body 101 which has a first end 102, and an opposite, distal, second end 103. Referring now to the enlarged view of FIG. 4, a key and keyway combination 90 and 91 respectively, are made integral with one end of the axle 100. This provides a means by which another drive member (not shown) may be releasably affixed to the axle and disposed in force receiving relation relative to the motor 13. As also seen in FIGS. 2 and 4, the opposite ends of the axle extend longitudinally outwardly relative to the imaging drum assembly 10. The main body 101 further defines an air intake passageway 104 which extends from the first to the second end of the main body 101. The air intake passageway 104 has a given diametral dimension which is at least one-half that of the inside diametral dimension of the inner, substantially cylindrically shaped sleeve which will be discussed hereinafter. Further, a plurality of substantially circular apertures 105 are formed in the main body 101 and oriented in a given pattern. In the preferred embodiment, the inside diametral dimension of the main body 101 of the axle is approximately 1.875 inches. Approximately 54 substantially circular apertures are formed in the main body of the axle 100. The operation of the axle 100 will also be discussed in greater detail hereinafter. Other aperture shapes can also be used provided that equal air pressure is maintained at each of the apertures.

As best seen in FIG. 2, a pair of collars 120 are mounted on the axle 100. The hubs or collars 120 have a main body 121 which is substantially cylindercal in shape, and which has a given outside diametral dimension. The main body 121 has a passageway 122 which has a given diametral dimension. The diametral dimension of the passageway 122 allows it to matingly receive, as in the nature of a telescoping fit, the main body 101 of the axle 100 at the first and second ends thereof 102 and 103, respectively. A pair of channels 123, are formed about the main body 121. A bearing 124 is received on the axle and thereby renders the collar and axle rotatable. Still further, the peripheral edge 125 of the main body is rounded to a predetermined amount to facilitate the mating receipt of the individual collars within the inner sleeve as seen in FIG. 2. The inner sleeve will be discussed in greater detail hereinafter. Further, a pair of longitudinally extending slots 126 are formed in each of the collars.

Figure 1:
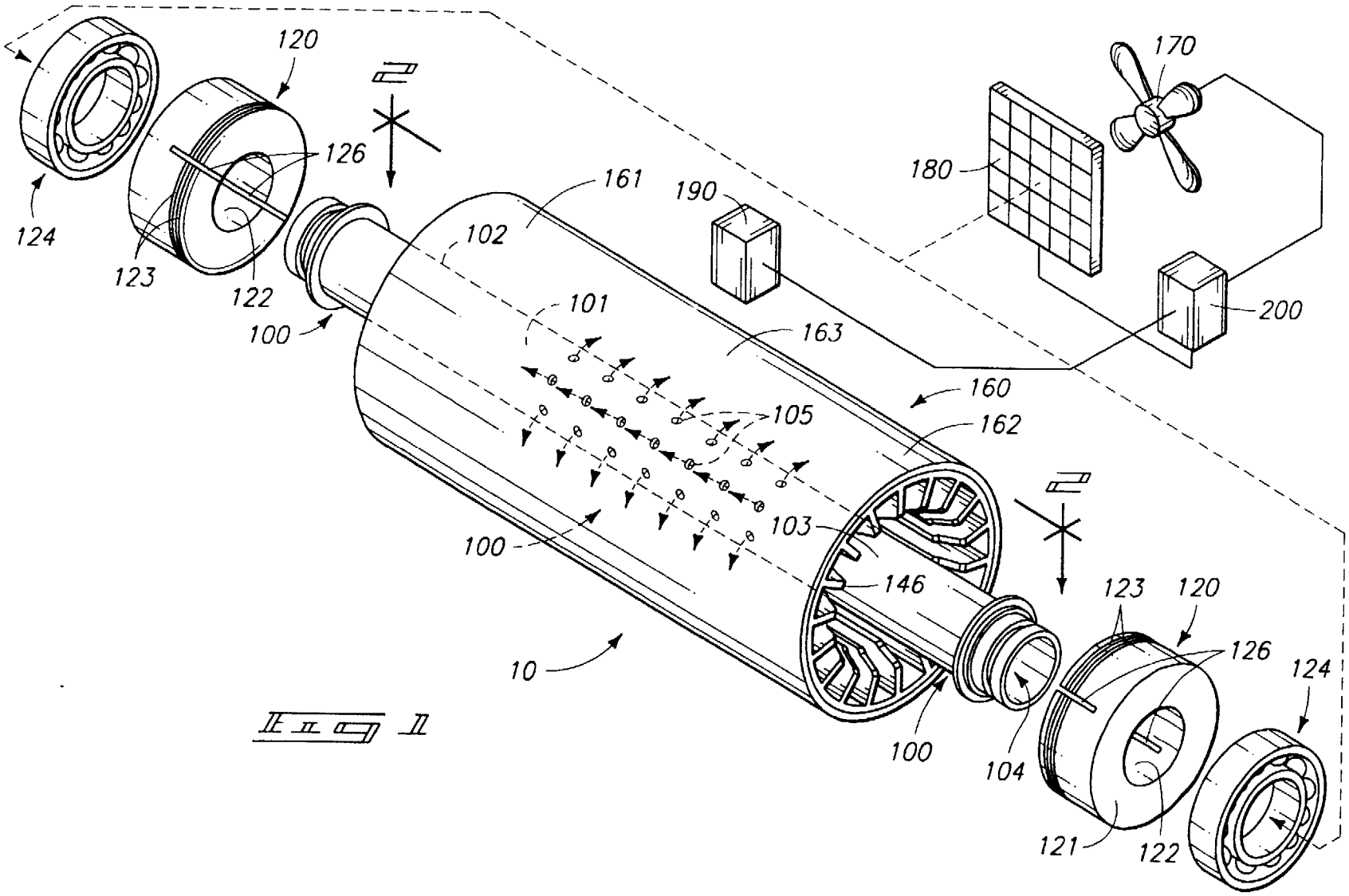
FIG. 1 is a perspective, exploded, fragmentary, environmental view of the imaging drum of the present invention with some underlying surfaces shown in phantom lines to illustrate the structure thereof.

An inner substantially cylindrically shaped sleeve 140 is mounted for simultaneous rotational movement with the axle 100 by means of the pair of collars 120 and the associated bearings 124. The inner substantially cylindrically shaped sleeve has an outwardly facing surface 141, and an opposite, inwardly facing surface 142 which defines a cavity 143 having a given inside diametral dimension. As noted earlier, the outside diametral dimension of the axle 100 is at least about one-half the size of the inside diametral dimension of the inner, substantially cylindrically shaped sleeve 140. Further, the inner sleeve 140 has a first end 144, and an opposite second end 145. As best seen in FIGS. 1 and 2, a plurality of spaced, inwardly radially extending projections, or fins 146, are made integral with the inwardly facing surface 142. As best seen in FIG. 2, a recessed area 147 is formed on each of the spaced inwardly radially extending projections or fins at the first and second ends 144 and 145 of the inner sleeve 140. As should be understood, the individual collars 120 are matingly received in this recessed area 147 and are secured therein by means of a friction fit.

The imaging drum assembly 10 includes an outer, substantially cylindrically shaped sleeve 160. The outer sleeve receives, in a telescoping manner, the inner sleeve 140. The inner and outer sleeves engage each other in the nature of a friction fit. The outer sleeve 160 has opposite first and second ends 161 and 162, respectively, and further has an outwardly facing surface 163 and an opposite inwardly facing surface 164. As will be recognized by a study of the drawings, the inwardly facing surface 164 defines an inside diametral dimension which is just slightly less than the outside diametral dimension of the inner cylindrically shaped sleeve 140. When fitted together, as shown in FIG. 2, the outwardly facing surface 141, of the inner sleeve 140 is oriented in energy transmitting relation relative to the inwardly facing surface 164 of the outer cylindrically shaped sleeve 160. Further, the outwardly facing surface 163 is provided with a coating 165 which accepts and retains an electrostatic charge. The coating 165, which is provided commercially by Delphax Systems, Inc. of Mississauga, Ontario, has a thickness of approximately 20 to 50 microns and provides a nominal capacitance of at least 170 pf per square centimeter.

Referring now to FIG. 1, a fan assembly 170 is mounted in fluid transmitting relation relative to the air intake passageway 104 of the axle 100. The fan assembly 170 urges a supply of ambient air through the air intake passageway 104 and out of the plurality of apertures 105 which are formed in the main body 101. As best appreciated by a study of FIG. 1, the fan assembly delivers the supply of air to the air intake passageway at the first and second ends of the axle 102 and 103, respectively. The air supplied to each end of the air intake passageway 104 by means of the fan assembly 170 has a given pressure. Further, when the air pressure is measured at each of the apertures 105 which are formed in the axle 100, it is substantially equal. As best understood by a study of FIG. 1, the air exiting through the apertures 105 moves along the inwardly facing surface 142 of the inner substantially cylindrically shaped sleeve 140. As such, this continuous air stream is operable to impart, or receive heat energy from the inner substantially cylindrically shaped sleeve 140.

A selectively adjustable heater 180 is oriented in heat transferring relation relative to the supply of air which is delivered by the fan assembly 170. Further, a sensor 190 is mounted in spaced, heat sensing relation relative to the outwardly facing surface 163 of the outer sleeve 160. The sensor 190 is coupled in signal transmitting relation, by means of a control assembly 200, to the selectively adjustable heater 180. As should be understood, the control assembly 200 is operable to maintain the outwardly facing surface of the imaging cylinder 10 at a given temperature in relative comparison to the operating temperatures of the respective pressure and fusion drums 20 and 30 respectively.

In particular, the control assembly 200 selectively operates the selectively adjustable heater 180 and fan assembly 170 in combination such that the outside facing surface 163 of the outer, cylindrically shaped sleeve 160 is maintained at a temperature of about 50 degrees C. to about 80 degrees C. Further, it has been discovered that when the fusion drum 30 is maintained at a temperature of about 120 degrees C. to about 130 degrees C. by means of the radiant heater 34; and the pressure drum 20, which is disposed in rotatable engagement with the fusion drum 30, is maintained at a temperature of substantially less than 100 degrees C.; then under those circumstances the imaging drum 10 is rendered operable to transfer more than 99 percent of the toner dispensed on same from the imaging drum 10, to the fusion drum 30. As should be understood, when the printer 11 is not in operation, the selectively adjustable heater is energized to impart heat energy to the air circulated to the cavity 143. In this condition, the heat energy is transmitted to the outer sleeve 160 by way of the inner sleeve 140, thereby maintaining the imaging drum within the range of about 50 to about 80 degrees C. However, during operation, because of the variation in the temperatures of the individual pressure 20, fusion 30, and imaging drums 10, heat energy is transmitted to the imaging drum 10. Therefore, during operation, the fan assembly 170 pumps air which may or may not have been previously heated through the air intake passageway and into the cavity 143. The air traveling into the cavity is operable to receive or impart heat energy which is transmitted from the outer cylindrically shaped sleeve 160 to the inner cylindrically shaped sleeve 140, and which is radiated into the cavity 143 by means of the plurality of spaced inwardly regularly extending projections or fins 146. In this arrangement, the air moving through the cavity 143 maintains the temperature of the outer cylindrically shaped sleeve within the preferred operation range noted above.

OPERATION

The operation of the described embodiment of the present invention is believed to be readily apparent and is briefly summarized at this point.

A first aspect of the present invention relates to an imaging drum assembly 10 which includes an inner substantially cylindrically shaped sleeve 140 having an outwardly facing surface 141 and an inwardly facing surface 142, and wherein the inwardly facing surface 142 has a plurality of spaced, inwardly radially extending projections 146 which define a cavity 143; and an outer, substantially cylindrically shaped sleeve 160, the outer sleeve telescopingly receiving the inner sleeve, and wherein the outer sleeve has an outwardly facing surface 163, and an inwardly facing surface 164 which is disposed in energy transmitting relation relative to the outwardly facing surface of the inner sleeve 140, and wherein the outwardly facing surface of the outer sleeve 160 has a given minimum capacitance.

More specifically, the imaging drum assembly of the present invention comprises an axle 100 having a main body 101 and defining an axis of rotation, and wherein the main body 101 of the axle 100 has opposite first and second ends 102 and 103, respectively, and wherein an air intake passageway 104 is formed in the main body and extends substantially coaxially from the first end of the main body to the second end thereof, and wherein a plurality of radially disposed apertures 105 are formed in the main body and communicate with the air intake passageway 104; a pair of collars 120 are mounted on the axle 100 and are disposed in spaced relation, one to the other, the individual collars 120 each having a main body 121 which telescopingly receives the main body 101 of the axle 100; a fan assembly 170 mounted in fluid transmitting relation relative to the air intake passageway 104 of the axle 100, the fan assembly 170 urging a supply of air through the air intake passageway 104 and out of the plurality of apertures 105, and wherein the fan assembly 170 delivers the supply of air to the air intake passageway at both the first and second ends of the axle 102 and 103 respectively, and wherein the air supplied to the air intake passageway has a given pressure, and wherein the air pressure when measured at each of the apertures 105 formed in the axle 100 is substantially equal; a selectively adjustable heater 180 disposed in heat transferring relation relative to the supply of air; an inner, substantially cylindrically shaped sleeve 140 borne by the individual collars 120 and rotatable with the axle 100, the inner sleeve having an outwardly facing surface 141, and an inwardly facing surface 142, and wherein the inwardly facing surface 142 has a plurality of spaced, inwardly radially extending projections 146 which define a cavity 143; an outer, substantially cylindrically shaped sleeve 160 telescopingly receiving the inner sleeve 140, and wherein the outer sleeve 160 has an outwardly facing surface 163, and an inwardly facing surface 164, which is disposed in energy transmitting relation relative to the outwardly facing surface 141 of the inner sleeve 140, and wherein the outwardly facing surface 163 of the outer sleeve 160 has a given minimum capacitance of greater than about 170 pf per square centimeter; a sensor 190 mounted in spaced heat sensing relation relative to the outwardly facing surface 163 of the outer sleeve 160, and wherein the sensor is coupled in signal transmitting relation relative to the selectively adjustable heater 180; and a control assembly 200 electrically coupled with the sensor 190, selectively adjustable heater, and fan assembly, and wherein the control assembly 200 upon receiving a given signal from the sensor 190 selectively activates the selectively adjustable heater and fan assembly for given time periods effective to maintain the temperature of the outwardly facing surface 163 of the outer sleeve 160 at about 50 degrees C. to about 80 degrees C.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. An imaging drum assembly, comprising:

an inner, substantially cylindercally shaped sleeve, the inner sleeve having an outwardly facinig surface, and an inwardly facing surface, and wherein the inwardly facing surface has a plurality of spaced, inwardly radially extending projections which define a cavity;

an outer, substantially cylindercally shaped sleeve, the outer sleeve telescopingly receiving the inner sleeve, and wherein the outer sleeve has an outwardly facing surface, and inwardly facing surface which is disposed in energy transmitting relation relative to the outwardly facing surface of the inner sleeve and wherein the outwardly facing surface of the outer sleeve has given dielectric properties effective to receive and retain an electrostatic latent image; and a rotatable axle telescopingly received internally of the inner sleeve and supporting the inner and outer sleeve for rotational movement therewith, and wherein the axle has opposite first and second ends and further defines an air intake passageway which extends from the first to the second end thereof, and wherein a supply of air is urged through the air intake passageway and into the cavity defined by the inner sleeve, and wherein the air is delivered at both the first and second ends thereof.

2. An imaging drum assembly as claimed in claim 1, wherein the axle further includes a plurality of apertures which are formed in a predetermined pattern in the axle and which communicate with the air intake passageway, and wherein the inner sleeve has a given inside diameter measurement and the axle has a given outside diameter measurement, and wherein the outside diameter measurement of the axle is at least one-half as large as the inside diameter measurement of the inner sleeve.

3. An imaging drum assembly as claimed in claim 2, and further comprising a fan assembly mounted in fluid transmitting relation relative to the air intake passageway of the axle, the fan assembly urging the supply of air through the air intake passageway.

4. An imaging drum assembly as claimed in claim 3, and further comprising a selectively adjustable heater which is disposed in heat transferring relation relative to the supply of air provided to the air intake passageway.

5. An imaging drum assembly as claimed in claim 4, and further comprising a sensor mounted in spaced, heat sensing relation relative to the outwardly facing surface of the outer sleeve, and wherein the sensor is coupled in signal transmitting relation relative to the selectively adjustable heater.

6. An imaging drum assembly as claimed in claim 5, wherein the temperature of the outwardly facing surface of the outer sleeve is substantially maintained at a temperature of about 50 degrees C. to about 80 degrees C., and wherein the given minimum capacitance is about 170 pf per square cm.

7. An imaging drum assembly as claimed in claim 6, wherein a fusion drum is disposed in rotatable engagement with the imaging drum assembly, the fusion drum maintained at a temperature of about 120 degrees C. to about 130 degrees C., and wherein a pressure drum is disposed in rotatable engagement with the fusion drum, the pressure drum being maintained at a temperature of substantially less than about 100 degrees C.

8. An imaging drum assembly as claimed in claim 7, wherein an imaging assembly is mounted in spaced relation relative to the imaging drum to form the electrostatic latent image thereon, and wherein a source of toner is disposed in toner dispensing relation relative to the imaging drum assembly, and wherein dispensed toner adheres to the electrostatic latent image formed on the imaging drum assembly, and wherein at least about 99% of the toner is transferred from the imaging drum assembly to the fusion drum.

9. An imaging drum assembly as claimed in claim 8, and further comprising a control assembly which is electrically coupled with the sensor, heating assembly, and fan assembly, and wherein the control assembly upon receiving a given signal from the sensor selectively activates the heater assembly for given time periods effective to maintain the temperature of the outer sleeve at about 50 degrees to about 80 degrees C.

10. An imaging drum assembly as claimed in claim 9, wherein the source of air supplied to the air intake passageway leaves the axle through the plurality of apertures formed in the axle, and wherein the supply of air is delivered at a given pressure, and wherein the pressure of the air exiting through each of the respective apertures is substantially equal.

11. An imaging drum assembly, comprising:

an axle having a main body and defining an axis of rotation, and wherein the main body of the axle has opposite first and second ends, and wherein an air intake passageway is formed in the main body and extends substantially coaxially from the first end of main body to the second end thereof, and wherein a plurality of radially disposed apertures are formed in the main body of the axle and communicate with the air intake passageway;

a pair of collars borne on the axle and disposed in spaced relation, one to the other, the individual collars each having a main body which extends substantially radially outwardly relative to the axle;

an inner, substantially cylindrically shaped sleeve borne by the pair of collars and rotatable with the axle, the inner sleeve having an outwardly facing, and an inwardly facing surface, and wherein the inwardly facing surface has a plurality of spaced inwardly radially extending projections which define a cavity, and wherein the individual collars are received in the cavity; and an outer, substantially cylindrically shaped sleeve, the outer sleeve telescopingly receiving the inner sleeve, and wherein the outer sleeve has an outwardly facing surface, and an inwardly facing surface which is disposed in energy transmitting relation relative to the outwardly facing surface of the inner sleeve, and wherein the outwardly facing surface of the outer sleeve has a given minimum capacitance.

12. An imaging drum assembly as claimed in claim 11, and further comprising a fan assembly mounted in fluid transmitting relation relative to the air intake passageway at the first and second ends of the axle, the fan assembly urging a supply of air through the air intake passageway from the first and second ends of the axle, the supply of air escaping into the cavity through the individual apertures formed in the axle.

13. An imaging drum assembly as claimed in claim 12, and further comprising a selectively adjustable heater which is disposed in heat transferring relation relative to the supply of air provided to the intake passageway.

14. An imaging drum assembly as claimed in claim 13, and further comprising a sensor mounted in spaced, heat sensing relation relative to the outwardly facing surface of the outer sleeve, and wherein the sensor is coupled in signal transmitting relation relative to the selectively adjustable heater.

15. An imaging drum assembly as claimed in claim 14, wherein the temperature of the outwardly facing surface of the outer sleeve is substantially maintained at a temperature of about 50 degrees C. to about 80 degrees C.

16. An imaging drum assembly as claimed in claim 15, wherein a fusion drum is disposed in rotatable engagement with the imaging drum assembly, the fusion drum maintained at a temperature of about 120 degrees C. to about 130 degrees C., and wherein a pressure drum is disposed in rotatable engagement with the fusion drum, the pressure drum being maintained at a temperature of substantially less than about 100 degrees C.

17. An imaging drum assembly as claimed in claim 16, wherein an imaging assembly is mounted in spaced relation relative to the imaging drum to form an electrostatic latent image thereon, and wherein a source of toner is disposed in toner dispensing relation relative to the imaging drum assembly, and wherein dispensed toner adheres to the charged area formed on the imaging drum assembly, and wherein at least about 99% of the toner is transferred from the imaging drum assembly to the fusion drum.

18. An imaging drum assembly as claimed in claim 17, and further comprising a control assembly which is electrically coupled with the sensor, heating assembly, and fan assembly, and wherein the control assembly upon receiving a given signal from the sensor selectively activates the heater assembly and fan assembly for given time periods effective to maintain the temperature of the outwardly facing surface of the outer sleeve at about 50 degrees to about 80 degrees C.

19. An imaging drum assembly as claimed in claim 18, wherein the source of air supplied to the air intake passageway leaves the axle through the plurality of apertures formed in the axle, and wherein the supply of air is delivered at a given pressure, and wherein the pressure of the air exiting through each of the respective apertures is substantially equal.

20. An imaging drum assembly, comprising:

an axle having a main body and defining an axis of rotation, and wherein the main body of the axle has opposite first and second ends, and wherein an air intake passageway is formed in the main body and extends substantially coaxially from the first end of main body to the second end thereof, and wherein a plurality of radially disposed apertures are formed in the main body and communicate with the air intake passageway;

a pair of collars borne on the axle and disposed in spaced relation, one to the other, the individual collars each having a main body which telescopingly receives the axle;

a fan assembly mounted in fluid transmitting relation relative to the air intake passageway of the axle, the fan assembly urging a supply of air through the air intake passageway and out of the plurality of apertures, and wherein the fan assembly delivers the supply of air to the air intake passageway at both the first and second ends of the axle, and wherein the air supplied to the air intake passageway has a given pressure, and wherein the air pressure when measured at each of the apertures formed in the axle is substantially equal;

a selectively adjustable heater disposed in heat transferring relation relative to the supply of air;

an inner, substantially cylindrically shaped sleeve borne by the individual collars and rotatable with the axle, the inner sleeve having an outwardly facing surface, and an inwardly facing surface, and wherein the inwardly facing surface has a plurality of spaced inwardly radially extending projections which define a cavity, and wherein the individual collars releasably engage the inner substantially cylinderally shaped sleeve;

an outer, substantially cylindrically shaped sleeve, the outer sleeve telescopingly receiving the inner sleeve, and wherein the outer sleeve has an outwardly facing surface, and an inwardly facing surface which is disposed in energy transmitting relation relative to the outwardly facing surface of the inner sleeve, and wherein the outwardly facing surface of the outer sleeve has a given minimum capacitance of greater than about 170 pf per square cm.;

a sensor mounted in spaced, heat sensing relation relative to the outwardly facing surface of the outer sleeve, and wherein the sensor is coupled in signal transmitting relation relative to the selectively adjustable heater; and a control assembly electrically coupled with the sensor, heating assembly, and fan assembly, and wherein the control assembly upon receiving a given signal from the sensor selectively activates the selectively adjustable heater and fan assembly for given time periods effective to maintain the temperature of the outwardly facing surface of the outer sleeve at about 50 degrees to about 80 degrees C.

* * * * *

UNITED STATES PATENT AND TRADEMARK OFFICE

CERTIFICATE OF CORRECTION

PATENT NO. : 5,788,382
DATED : August 4, 1998
INVENTOR(S) : Benjamin L. Egbert et al.

It is certified that error appears in the above-identified patent and that said Letters Patent is hereby corrected as shown below:

In the body of the ABSTRACT, on page 1, at the end of line 6, after the word "substantially", insert the word --cylindrically--

In column 8, line 4, delete the word "facinig" and insert the word --facing--

Signed and Sealed this

Third Day of November, 1998

*Attest:*

*Attesting Officer*

BRUCE LEHMAN

*Commissioner of Patents and Trademarks*